US005183556A

United States Patent [19]

Reilly et al.

[11] Patent Number: 5,183,556

[45] Date of Patent: Feb. 2, 1993

[54] PRODUCTION OF DIESEL FUEL BY HYDROGENATION OF A DIESEL FEED

[75] Inventors: James W. Reilly, Westfield; Gary Hamilton, Shrewsbury, both of N.J.

[73] Assignee: ABB Lummus Crest Inc., Bloomfield, N.J.

[21] Appl. No.: 668,869

[22] Filed: Mar. 13, 1991

[51] Int. Cl.[5] ..... C10G 45/00

[52] U.S. Cl. ..... 208/57; 208/143; 208/144; 585/270

[58] Field of Search ..... 208/57, 143, 144

[56] References Cited

U.S. PATENT DOCUMENTS

| | | | |
|---|---|---|---|
| 3,450,784 | 6/1969 | Reilly et al. | 260/667 |
| 3,459,656 | 8/1969 | Rausch | 208/57 |
| 3,527,693 | 9/1970 | Barnes et al. | 208/57 |
| 3,767,562 | 10/1973 | Sze et al. | 208/57 |
| 3,775,291 | 11/1973 | Sze | 208/57 |
| 3,846,278 | 11/1974 | Sze et al. | 208/57 |
| 4,172,815 | 10/1979 | Jacobs | 208/102 |
| 4,263,127 | 4/1981 | Rausch et al. | 208/57 |
| 4,325,804 | 4/1982 | Everett et al. | 208/58 |
| 4,409,092 | 10/1983 | Johnson et al. | 208/89 |
| 4,501,653 | 2/1985 | Hammer | 208/89 |
| 4,828,676 | 5/1989 | Sawyer et al. | 208/57 |
| 4,927,520 | 5/1990 | Kalnes et al. | 208/57 |

*Primary Examiner*—Helane Myers

*Attorney, Agent, or Firm*—Elliot M. Olstein; Raymond J. Lillie

[57] ABSTRACT

A process for producing diesel fuel from a diesel hydrocarbon feed. Hydrogen is fed cocurrently with the feed to a first hydrogenation zone in the presence of a hydrogenation catalyst. Liquid effluent from the first hydrogenation zone is then passed to a second hydrogenation zone, wherein the liquid effluent is contacted countercurrently with hydrogen in the presence of a hydrogenation catalyst. Preferred hydrogenation catalysts are those comprising non-noble metals in the first hydrogenation zone, and may comprise noble or non-noble metals in the second hydrogenation zone.

14 Claims, 4 Drawing Sheets

PRODUCTION OF DIESEL FUEL BY HYDROGENATION OF A DIESEL FEED

This invention relates to the production of diesel fuel from a hydrocarbon feedstock. More particularly, this invention relates to the production of diesel fuel through the hydrogenation of an aromatics-containing hydrocarbon feedstock in first and second hydrogenation zones to produce thereby a diesel fuel with a reduced aromatics content.

In the production of diesel fuel, the diesel fuel produced from the conversion of a hydrocarbon feed should be environmentally and economically acceptable. Acceptable diesel fuels have a low sulfur content (e.g., 500 ppm maximum), and a low aromatics content. It has been foreseen that diesel specifications may be set which are similar to the specifications of European diesel fuels, which may have a cetane index of 45–50 and an aromatics content which does not exceed 20–25%.

It is therefore an object of the present invention to provide an economical process for making diesel fuel, which has an acceptable reduced aromatics content, from an aromatics-containing hydrocarbon feed.

In accordance with an aspect of the present invention, there is provided a process for producing diesel fuel by hydrogenation of a hydrocarbon feed. The feed has an about 10% by volume boiling point of from about 300° F. to about 500° F., and an about 90% by volume boiling point of at least about 500° F. and no greater than 750° F. The process comprises passing the hydrocarbon feed in cocurrent contact with hydrogen gas through a first hydrogenation zone in the presence of a hydrogenation catalyst, thereby at least partially hydrogenating the feed. A gas phase effluent is removed from the first hydrogenation zone. The gas phase effluent comprises hydrogen and vaporized liquid materials. A partially hydrogenated liquid hydrocarbon effluent is also removed from the first hydrogenation zone. The liquid hydrocarbon effluent is further hydrogenated in a second hydrogenation zone by passing hydrogen gas into the second hydrogenation zone countercurrently to the liquid hydrocarbon effluent in the presence of a hydrogenation catalyst. A gas phase effluent comprising hydrogen and vaporized liquid material, and a liquid phase effluent comprising diesel fuel is recovered from the second hydrogenation zone.

In one embodiment, at least 40% of the feed includes materials having a boiling point above 550° F.

A representative example of a diesel hydrocarbon feed which may be hydrogenated in accordance with the present invention has the following characteristics:

| | |
|---|---|
| Density, A.P.I. | 20–35 |
| H/C Atomic Ratio | 1.4–1.9 |
| Sulfur, wt. % | 0.2–1.2 |
| Nitrogen, wt. % | 0.01–0.1 |
| FIA, vol. % | |
| Aromatics | 35–80 |
| Olefins | 1–4 |
| Saturates | Balance |
| Distillation, °F. | |
| Initial Boiling Point | 310–420 |
| 10% | 440–490 |
| 50% | 530–560 |
| 90% | 625–660 |
| End Point | 680–720 |

It is to be understood, however, that the scope of the present invention is not to be limited to such a diesel hydrocarbon feed.

In a preferred embodiment, the catalyst in the first hydrogenation zone comprises a non-noble metal. As representative examples of such catalysts, there may be mentioned nickel, Raney nickel, cobalt-molybdenum, nickel-molybdenum, and nickel-tungsten. The catalyst in the second hydrogenation zone may comprise a noble metal or non-noble metal. Examples of noble metal catalysts include, but are not limited to, platinum and palladium.

The catalyst is preferably supported on a support such as, but not limited to, alumina, silica, kieselguhr, diatomaceous earth, magnesia, zirconia, or other inorganic oxides, or zeolites, alone or in combination.

Preferably, the first hydrogenation zone is operated at a temperature of from about 550° F. to about 750° F., more preferably from about 600° F. to about 710° F., at a pressure of from about 600 psig to about 2,000 psig, more preferably from about 750 psig to about 1,500 psig, and at an LHSV of 0.3 $hr.^{-1}$ to about 2.0 $hr.^{-1}$. The second hydrogenation zone preferably is operated at a temperature of from about 550° F. to about 700° F., more preferably from about 600° F. to about 675° F., at a pressure of from about 600 psig to about 2,000 psig, more preferably from about 750 psig to about 1,500 psig, and at an LHSV of from about 0.3 hr. −1 to about 2.0 hr. −1. The two hydrogenation zones may be in a single reactor or in different reactors, and each hydrogenation zone includes at least one reaction stage.

In a preferred embodiment, the gas phase effluent from the first and second hydrogenation zones are cooled sufficiently to condense at least a portion of the vaporized liquid components thereof, and the condensed vaporized liquid components are separated from the remaining gas components and returned as liquid feed to the first or to the second hydrogenation zone. When such liquid feed is returned to the second hydrogenation zone, the liquid feed acts as a quench of the feed to the second hydrogenation zone (i.e., the liquid effluent from the first hydrogenation zone) and to control the maximum temperature in the second hydrogenation zone.

In one alternative, all of the vaporized liquid components are condensed and returned as a liquid feed to the first or second hydrogenation zone, whereas in another alternative, a portion of the vaporized liquid components is condensed to separate materials boiling above about 350° F., from the normally gaseous components which include hydrogen normally lighter liquid materials such as gasoline. Preferably, such components boil between about 85° F. and about 350° F. The non-condensed components may be passed to a separation zone, whereby gasoline and/or other lower-boiling materials are separated from hydrogen. The gasoline may be recovered for further use, whereas the hydrogen may be recycled to the first and/or second hydrogenation zone.

In yet another embodiment, the first hydrogenation zone includes first and second reaction stages, and the second hydrogenation zone includes one reaction stage. Such an embodiment is especially useful for hydrogenating diesel feeds having a high aromatics content (e.g., about 80 vol. % (FIA) or more). In such an embodiment, each of the reaction stages of the first hydrogenation zone are operated at the temperatures, pressures, and LHSV's as hereinabove described, and each reaction stage preferably includes a non-noble metal hydrogenation catalyst.

Most preferably, when such an embodiment of the first hydrogenation zone is employed, the gas phase effluents from the first and second hydrogenation zones are cooled sufficiently to condense at least a portion of the vaporized liquid components thereof, and the condensed vaporized liquid components are separated from the remaining gas components, and returned as liquid feed to the first or to the second hydrogenation zone. The remaining gas components, which include hydrogen are divided into a first hydrogen-containing gas stream and a second hydrogen-containing gas stream. The first hydrogen-containing gas stream is heated, preferably to a temperature of from about 550° F. to about 750° F. and is passed to the first reaction stage of the first hydrogenation zone. The second hydrogen-containing gas stream is passed to the second reaction stage of the first hydrogenation zone as a "cold" hydrogen stream; i.e., the stream is not preheated and preferably is at a temperature of from about 100° F. to about 140° F., and acts as a quench of the effluent from the first reaction stage prior to the entry of the effluent into the second reaction stage of the first hydrogenation zone.

The invention will now be described with respect to the drawings, wherein.

Figure 1:
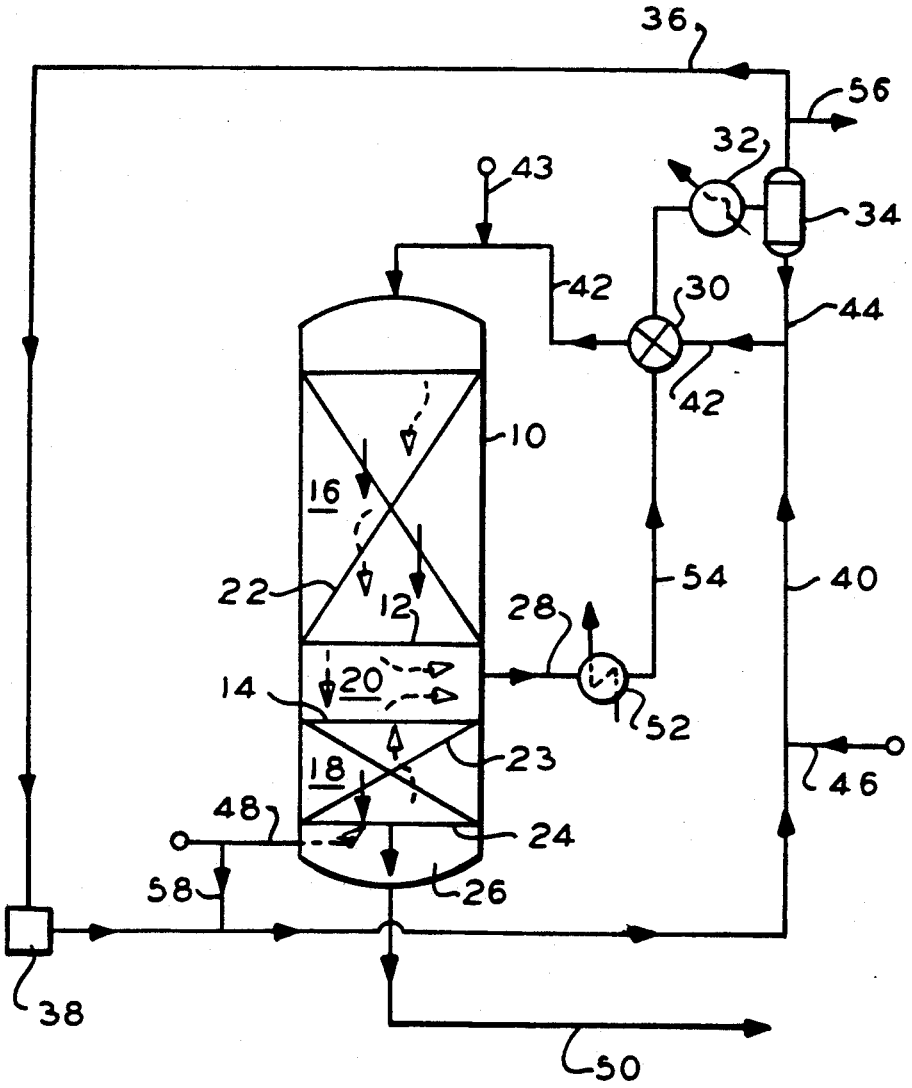
FIG. 1 is a schematic of a first embodiment of the hydrogenation process of the present invention.

Referring now to the drawings, as shown in FIG. 1, the hydrogenation of an aromatics-containing diesel hydrocarbon feed takes place in a reactor 10, divided by horizontal partitions 12, 14, and 24, which may be perforated or foraminous plates. Partitions 12, 14, and 24 divide reactor 10 into a first, or upper reaction zone 16, a vapor-disengaging zone 20, and a second or lower reaction zone 18.

The first reaction zone 16 is packed with a fixed bed 22 of a non-noble metal hydrogenation catalyst supported on partition 12. Second reaction zone 18 is packed with a fixed bed 23 of hydrogenation catalyst which may be a noble metal or non-noble metal hydrogenation catalyst. Catalyst bed 23 is supported on partition 24. Partition 24 is spaced above the bottom of the reactor, thereby defining the upper boundary of a lower chamber or zone 26.

A fresh aromatics-containing diesel feed is passed from line 46 to line 40, which is also supplied with a hydrogen-rich stream from line 36. The mixture of fresh feed and hydrogen proceeds in line 40 until it joins line 44, which contains a condensed recycle liquid from separator 34. The mixture of fresh feed, hydrogen, and recycle liquid passes through line 42, and through heat exchanger 30, and into the top of hydrogenation reactor 10 and into first hydrogenation zone 16. Alternatively, if the fresh feed is sufficiently hot not to require preheating, the feed may be introduced into line 42 from line 43.

The mixture of fresh feed, recycle liquid, and hydrogen passes downwardly through the catalyst bed 22 of first hydrogenation zone 16, under conditions whereby a substantial amount of the aromatics are hydrogenated to form desired diesel fuel products. Preferably, the first hydrogenation zone is operated at a temperature of from about 550° F. to about 750° F., more preferably from about 600° F. to about 710° F., and at a pressure of from about 600 psig to about 2,000 psig, more preferably from about 750 psig to about 1,500 psig and at an LHSV of from about 0.3 to about 2.0 $hr.^{-1}$. The effluent from the first hydrogenation zone 16 is a two-phase mixture of a liquid phase and a gas phase. The liquid phase is a mixture of the higher boiling components of the fresh feed. The gas phase is a mixture of hydrogen, inert gaseous impurities, and vaporized liquid hydrocarbons of a composition generally similar to that of the lower boiling components in the fresh feed.

The liquid phase of the effluent passes downwardly through vapor-disengaging zone 20 through partition 14 and into second hydrogenation zone 18.

In second hydrogenation zone 18, make-up hydrogen introduced through line 48 is passed through chamber 26 and upwardly through catalyst bed 23 of second hydrogenation zone 18, whereby the hydrogen contacts the liquid phase effluent countercurrently, thereby hydrogenating remaining aromatics. Preferably, such countercurrent contacting is accomplished with "cold" make-up hydrogen which is at a temperature of from about 100° F. to about 140° F. The countercurrent contacting of the liquid effluent with "cold" hydrogen serves to effect a high $H_2$ partial pressure and a cooler operation temperature, both of which are favorable for shifting chemical equilibrium towards saturated compounds (i.e., providing for higher aromatics conversion.) Preferably, the second hydrogenation zone 18 is operated at a temperature of from about 550° F. to about 700° F., more preferably from about 600° F. to about 675° F., at a pressure of from about 600 psig to about 2,000 psig, preferably from about 750 psig to about 1,500 psig, and at an LHSV of from about 0.3 $hr.^{-1}$ to about 2.0 $hr.^{-1}$.

In addition, the countercurrent contacting of the liquid effluent with hydrogen gas in second hydrogenation zone 18 acts to strip dissolved $H_2S$ and $NH_3$ impurities from the liquid effluent, thereby improving both the hydrogen partial pressure and, therefore, the catalyst's kinetic performance.

The liquid effluent which passes from second hydrogenation zone 18 is then accumulated in chamber 26 of reactor 10, to permit disengagement of vapors and sealing the outlet to line 50 to prevent the escape of hydrogen. The liquid product is collected in line 50, and contains the desired diesel fuel product. The liquid may then be processed further (e.g., by distillation) to remove impurities from the diesel feed.

A gas phase effluent from second hydrogenation zone 18 is also formed. This gas phase effluent contains excess hydrogen, inert gaseous impurities, and vaporized hydrocarbons of a composition similar to those contained in the gas phase effluent from first hydrogenation zone 16.

The gas phase effluents from first hydrogenation zone 16 and second hydrogenation zone 18 collect in vapor-disengaging zone 20. The combined gas phase fraction is withdrawn through line 28, and is cooled by being passed through heat exchanger 52. The vapor mixture is then passed through line 54 to condenser/heat exchanger 30, in which the vapor mixture, still hot, is used to preheat the reactor feed in line 42. The vapor mixture is then passed to condenser 32, wherein the vaporized liquid components are recondensed to liquids. The resulting two-phase (gas and liquid) mixture, containing hydrogen, inert gases, and reliquefied hydrocarbons, is passed to separator 34, where the liquid and gas phases are separated. The liquid phase is passed to line 44, and then is mixed with fresh feed and hydrogen from line 40, in line 42, and is recycled to the first hydrogenation zone 16 of reactor 10. The gas phase, which includes hydrogen and inert gases, is withdrawn from separator 34 through line 36. The gases in line 36 may be partially vented through line 56 to prevent the buildup of inert gaseous impurities in the system.

The remainder of the gas phase in line 36 is passed through compressor 38, and then to line 40, wherein the gas phase is mixed with fresh feed from line 46. Fresh hydrogen gas from line 48 may be passed to line 58 and passed to line 36, wherein the fresh hydrogen is mixed with the recycle gas, in the event the amount of recycle hydrogen is insufficient to meet the requirements of first hydrogenation zone 16.

Figure 2:
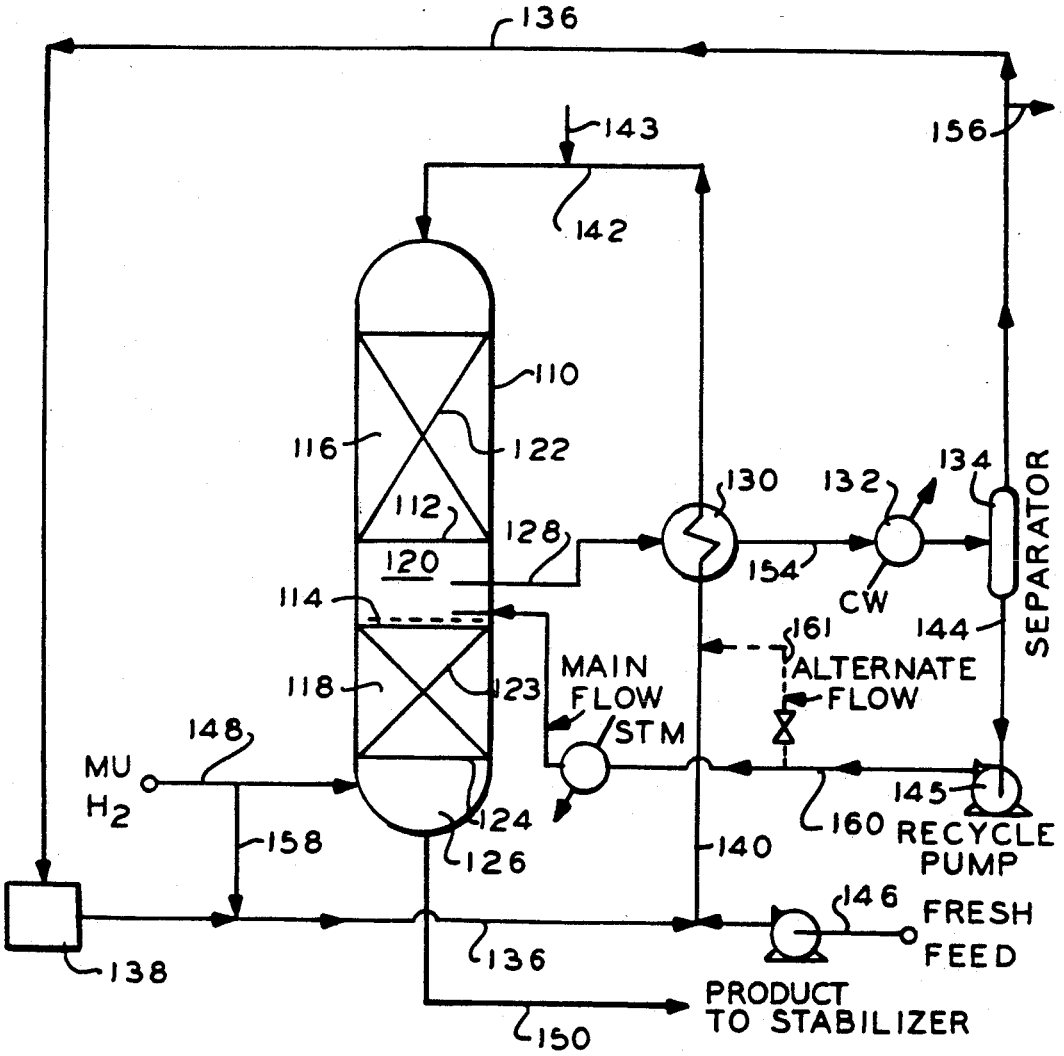
FIG. 2 is a schematic of a second embodiment of the process of the present invention.

In one alternative, as shown in FIG. 2, a fresh diesel feed from line 146 and a gas stream containing hydrogen in line 136 are combined in line 140, passed through heat exchanger 130, whereby the diesel feedstock and hydrogen are heated, passed to line 142, and then passed to first hydrogenation zone 116 of reactor 110. Alternatively, if the feed does not require preheating, it may be introduced into line 142 from line 143. The feed contacts a fixed bed 122 of non-noble metal hydrogenation catalyst, and the effluent, containing a liquid phase and a gas phase, passes through partition 112 to vapor disengaging zone 120. The liquid phase of the effluent passes downwardly through vapor disengaging zone 120, through partition 114, and into second hydrogenation zone 118.

In second hydrogenation zone 118, hydrogen introduced through line 148, and chamber 126 contacts the liquid phase effluent countercurrently, as the effluent passes through catalyst bed 123, thereby hydrogenating remaining aromatics in the liquid effluent. The liquid portion of the effluent from second hydrogenation zone 118 passes through partition 124 into chamber 126, permitting the disengagement of vapors and the sealing of the outlet to line 150 to prevent escape of hydrogen. A liquid diesel fuel product is recovered from line 150.

The gas phase effluents from first hydrogenation zone 116 and second hydrogenation zone 118 are collected in vapor disengaging zone 120. The combined gas fraction is withdrawn through line 128, and is passed through condenser/heat exchanger 130, whereby the hot vapor mixture of hydrogen, inert gas, and vaporized liquid hydrocarbons is used to preheat the feed from line 140. The gaseous mixture is then passed through line 154, and condenser 132, whereby the vaporized liquid phase components are recondensed to liquids. The resulting two-phase (liquid and gas) mixture is passed to separator 134, where the liquid and gas phases are separated. The liquid phase is passed to line 144, recycle pump 145, and line 160 to vapor-disengaging zone 120. A portion of the liquid phase may be diverted through line 161 and passed to line 140 as recycle to first hydrogenation zone 116.

The liquid recycle stream in line 160, which is passed to vapor-disengaging zone 120, contacts "hot" liquid phase effluent from first hydrogenation zone 116, and acts as a quench to lower the temperature of the liquid effluent to a suitable inlet temperature, and to control the maximum temperature of catalyst bed 123.

The gas phase is withdrawn from separator 134 through line 136. The gas in line 136 may be partially vented through line 156 to prevent the buildup of inert gaseous impurities in the system. The remainder of the gas phase in line 136 is passed through compressor 138, and then to line 140, wherein the gas phase is mixed with fresh feed from line 146. Fresh hydrogen gas from line 148 may be passed to line 158 and passed to line 136, wherein the fresh hydrogen is mixed with the recycle gas, in the event the amount of recycle hydrogen is insufficient to meet the requirements of first hydrogenation zone 116.

Figure 3:
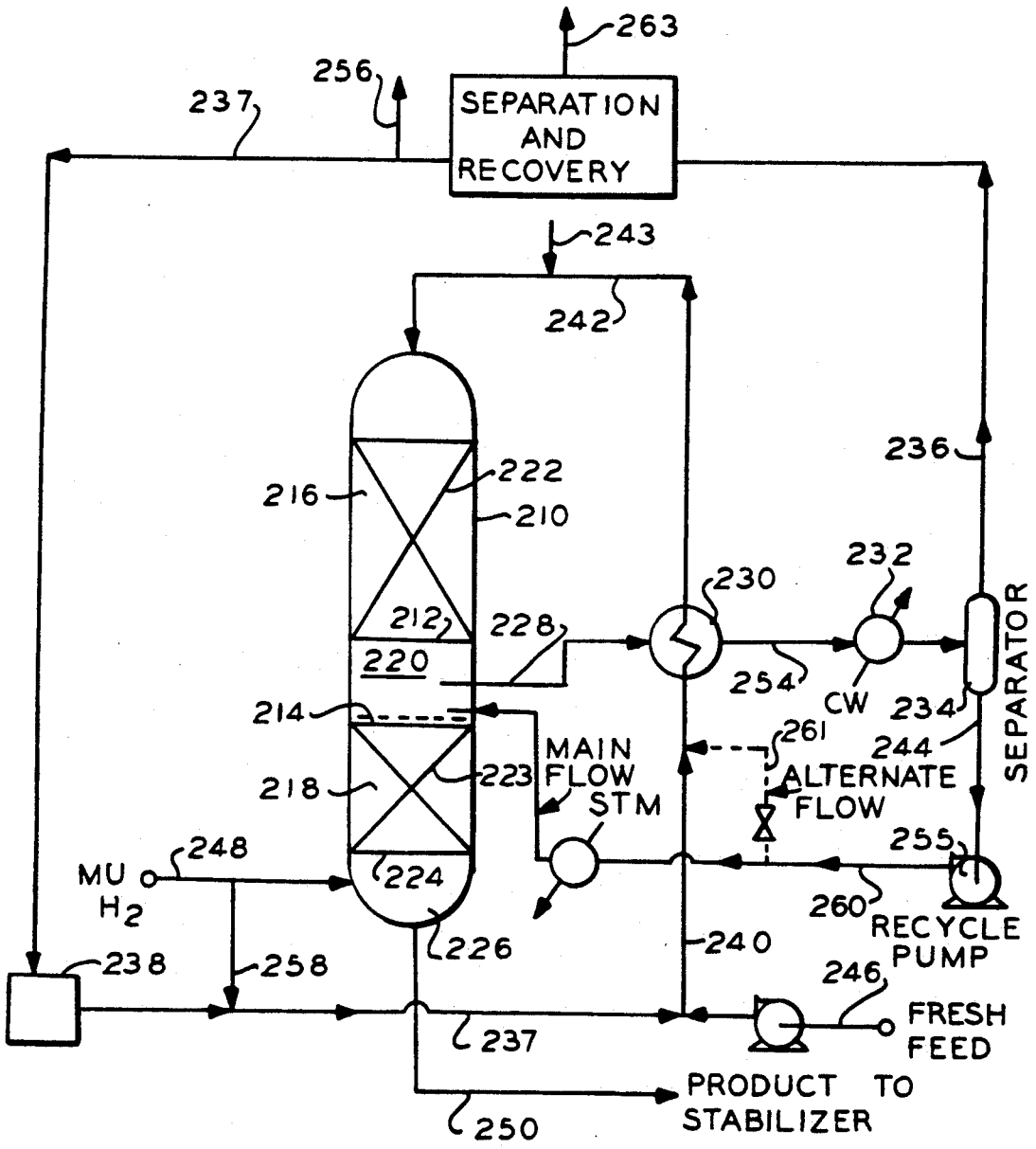
FIG. 3 is a schematic of a third embodiment of the hydrogenation process of the present invention.

In another alternative, as shown in FIG. 3, a fresh diesel feed from line 246 and a gas stream containing hydrogen in line 237 are combined in line 240, passed through heat exchanger 230, whereby the diesel feedstock and hydrogen are heated. The mixture of diesel feed and hydrogen is then passed to line 242, and then to first hydrogenation zone 216 of reactor 210. Alternatively, if the feed does not require preheating, it may be introduced into line 242 from line 243. The feed contacts a fixed bed 222 of non-noble metal hydrogenation catalyst, and the reaction effluent from first hydrogenation zone 216 passes through partition 212 to vapor-disengaging zone 220. The effluent contains a liquid phase and a gas phase. The liquid phase of the effluent passes downwardly through vapor disengaging zone 220, through partition 214, and into second hydrogenation zone 218.

In second hydrogenation zone 218, hydrogen introduced through line 248 and chamber 226 contacts the liquid phase effluent countercurrently as the effluent passes through catalyst bed 223, thereby hydrogenating remaining aromatics in the liquid effluent. The liquid phase portion of the effluent from second hydrogenation zone 218 passes through partition 224 into chamber 226, thereby permitting the disengagement of vapors and the sealing of the outlet to line 250 to prevent escape of hydrogen. A liquid diesel fuel product is recovered from line 250 and is further processed to remove any impurities.

The gas phase effluents from first hydrogenation zone 216 and second hydrogenation zone 218 are collected in vapor disengaging zone 220. The combined gas fraction is withdrawn through line 228, and is passed through condenser/heat exchanger 230, whereby the hot vapor mixture of hydrogen, inert gas, and vaporized liquid hydrocarbons is used to preheat the feed in line 240. The gaseous mixture is then passed through line 254, and condenser 232. In condenser 232, a heavy portion of the vaporized liquid hydrocarbons, having a boiling point generally above about 350° F., is condensed to form a liquid phase, while the remaining gases include hydrogen, inert gases, and gasoline and lighter components having a boiling point from about 85° F. to about 350° F. The gas and liquid phases are then passed to separator 234, wherein the gas and liquid phases are separated. The liquid phase, containing condensed heavy hydrocarbons, is withdrawn from separator 234 through line 244, passed to recycle pump 255, and line 260, and recycled to vapor-disengagement zone 220. The recycle liquid acts as a quench to lower the temperature of the liquid effluent from first hydrogenation zone 216, and to control the maximum temperature of catalyst bed 223, as previously described.

The gas phase is withdrawn from separator 234 through line 236. The gas phase contains hydrogen, inert gases, and gasoline and other light hydrocarbons generally boiling below about 350° F. The gas phase is then passed to a separation and recovery system 262, whereby the gas phase is separated into a liquid fraction containing gasolines and light hydrocarbons, and a gas fraction containing hydrogen and inert gases. The liquid fraction is recovered from line 263, and the gas fraction, containing hydrogen and inert gases, is withdrawn through line 237, passes through compressor 238, and then is mixed with fresh feed from line 246 in line 240. A portion of the gas phase may be vented through line 256 to prevent the buildup of inert gaseous impurities. Fresh hydrogen gas from line 248 may be passed to line 258, and passed to line 237, wherein the fresh hydrogen is mixed with the recycle gas, in the event the amount of recycle hydrogen is insufficient to meet the requirements of first hydrogenation zone 216.

Figure 4:
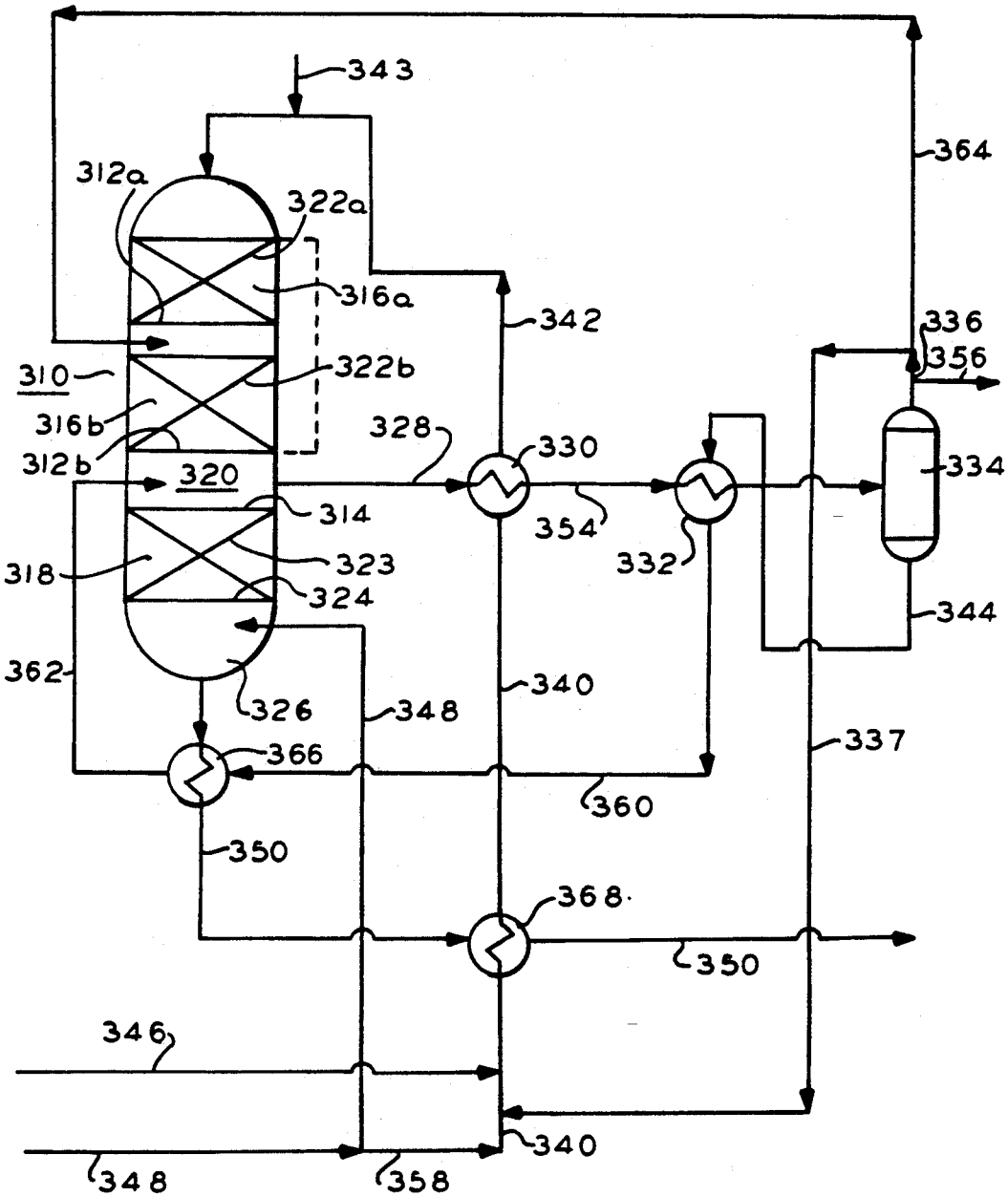
FIG. 4 is a schematic of a fourth embodiment of the hydrogenation process of the present invention.

In yet another alternative, as shown in FIG. 4, a fresh diesel feed in line 346, and gas streams containing fresh hydrogen in line 358 and recycle hydrogen in line 337 are combined in line 340, passed through heat exchangers 368 and 330, whereby the diesel feedstock and hydrogen are heated to a temperature of from about 550° F. to about 750° F. The mixture of diesel feed and hydrogen is then passed to line 342, and then to the first reaction stage 316*a* of the first hydrogenation zone 316 of reactor 310. Alternatively, if the feed does not require preheating, it may be introduced into line 342 from line 343. The feed contacts a fixed bed 322*a* of non-noble metal hydrogenation catalyst, and the reaction effluent from first reaction stage 316*a* passes through partition 312*a* to the second reaction stage 316*b* of the first hydrogenation zone 316. The effluent, prior to entering second reaction stage 316*b*, is contacted with recycle "cold" hydrogen, from line 364, which is at a temperature of from about 100° F. to about 140° F. The "cold" hydrogen thus acts as a quench of the effluent from reactor stage 316*a*.

Upon being quenched by the recycle "cold" hydrogen, the effluent is passed to the second reactor stage 316*b* of the first hydrogenation zone 316, wherein the effluent contacts fixed bed 322*b* of a non-noble metal catalyst. The reaction effluent then passes through partition 312*b* to vapor-disengaging zone 320. The effluent contains a liquid phase and a gas phase. The liquid phase of the effluent from reaction stage 316*b* passes downwardly through vapor disengaging zone 320, through partition 314, and into second hydrogenation zone 318.

In second hydrogenation zone 318, hydrogen introduced through line 348 and chamber 326 contacts the liquid phase effluent countercurrently as the effluent passes through catalyst bed 323, thereby hydrogenating remaining aromatics in the liquid effluent. The liquid phase portion of the effluent from second hydrogenation zone 318 passes through partition 324 into chamber 326, thereby permitting the disengagement of vapors and sealing of the outlet to line 350 to prevent the escape of hydrogen. A liquid diesel fuel product is recovered from line 350 after being passed through heat exchangers 366 and 368, and is further processed to remove any impurities.

The gas phase effluents from second reaction stage 316*b* of the first hydrogenation zone 316, and second hydrogenation zone 318 are collected in vapor disengaging zone 320. The combined gas fraction is withdrawn through line 328, and is passed through heat exchanger 330, whereby the hot vapor mixture of hydrogen, inert gas, and vaporized liquid hydrocarbons is used to preheat the feed in line 340. This mixture is then passed through line 354, and condenser 332. In condenser 332, at least a portion of the vaporized liquid phase components are recondensed to liquids. The resulting two-phase (liquid and gas) mixture is passed to separator 334, whereby the liquid and gas phases are separated. The liquid phase is withdrawn from separator 334 through line 344, and is passed through condenser/heat exchanger 332, line 360, heat exchanger 366, and line 362 to vapor disengaging zone 320. Heat exchangers 332 and 366 serve to heat the liquid phase as it is recycled to vapor disengaging zone 320 and second hydrogenation zone 318.

The gas phase, which includes hydrogen, is withdrawn from separator 334 through line 336. The gas in line 336 may be partially vented through line 356 to prevent the buildup of gaseous impurities in the system. The remainder of the gas phase is split into two hydrogen-containing gas streams. The first stream, in line 337, and containing recycle hydrogen, is passed to line 340, wherein the first stream is mixed with fresh feed and make-up hydrogen. The mixture of make-up hydrogen, recycle hydrogen, and fresh feed, is heated in heat exchangers 368 and 330, and passed to line 342 to be fed to first reaction stage 316*a* of the first hydrogenation zone as hereinabove described. The second gas stream, also containing recycle hydrogen, is passed to line 364. This stream is not heated and contains "cold" hydrogen, which is passed to second reaction stage 316*b* of the first hydrogenation zone, whereby the "cold" hydrogen acts to quench the effluent from first reaction stage 316*a*.

Advantages of the present invention include the provision of an economical means to convert an aromatics-containing diesel feed to a diesel fuel product which is environmentally acceptable. The present invention, by employing co-current contacting of the feed with hydrogen in the first hydrogenation zone followed by countercurrent contacting of the feed with hydrogen provides for a favorable hydrogen partial pressure profile to complete the reactions necessary for the formation of a superior diesel fuel product. In addition, when the recycled condensed liquid hydrocarbons are recycled to the second hydrogenation zone, such recycled liquid quenches the liquid effluent from the first hydrogenation zone and controls the maximum temperature of the catalyst bed in the second hydrogenation zone. The present invention also enables one, if desired, to separate the gas phase effluent from both hydrogenation zones into heavy and light fractions, whereby a condensed heavy fraction is recycled to either the first or second hydrogenation zone, and a gaseous light fraction is further processed so as to recover a gasoline product.

A representative example of a diesel fuel recovered as product may have the following characteristics:

| | |
|---|---|
| Density, A.P.I. | 33–36 |
| H/C Atomic Ratio | 1.7–2.0 |
| Sulfur | <500 ppm |
| Nitrogen, wt. % | <5 ppm |
| FIA, vol. % | |
| Aromatics | 20–35 |
| Olefins | 0.3–0.7 |
| Saturates | Balance |
| Distillation, °F. | |
| Initial Boiling Point | 400 |
| 10% | 470 |

-continued

| | |
|---|---|
| 50% | 550 |
| 90% | 650 |
| End point | 690 |

It is to be understood that the scope of the present invention is not to be limited to this specific diesel product.

It is also contemplated that diesel products having aromatics contents as low as 5–10 vol.% or lower may also be obtained by the process of the present invention.

It is to be understood, however, that the scope of the present invention is not to be limited to the specific embodiments described above. The invention may be practiced other than as particularly described and still be within the scope of the accompanying claims.

What is claimed is:

1. A process for producing diesel fuel by hydrogenation of a hydrocarbon feed, comprising:

passing a hydrocarbon feed in cocurrent contact with a hydrogen gas through a first hydrogenation zone in the presence of a hydrogenation catalyst, thereby at least partially hydrogenating said feed, said feed having an about 10% by volume boiling point of from about 300° F. to about 500° F. and an about 90% by volume boiling point of at least about 500° F. and no greater than 750° F.

removing from said first hydrogenation zone a gas phase effluent comprising hydrogen and vaporized liquid materials, and a partially hydrogenated liquid hydrocarbon effluent;

further hydrogenating the liquid hydrocarbon effluent in a second hydrogenation zone by passing a hydrogen-rich gas into the second hydrogenation zone countercurrently to the liquid hydrocarbon effluent in the presence of a hydrogenation catalyst; and recovering from said second hydrogenation zone a gas phase effluent comprising hydrogen and vaporized liquid material and a liquid phase effluent comprising diesel fuel.

2. The process of claim 1 wherein at least 40% of said feed includes materials having a boiling point above 550° F.

3. The process of claim 1 wherein said catalyst in said first hydrogenation zone comprises a non-noble metal.

4. The process of claim 1 wherein said first hydrogenation zone is operated at a temperature of from about 550° F. to about 750° F.

5. The process of claim 1 wherein said first hydrogenation zone is operated at a pressure of from about 600 psig to about 2,000 psig.

6. The process of claim 1 wherein said second hydrogenation zone is operated at a pressure of from about 600 psig to about 2,000 psig.

7. The process of claim 1 wherein said second hydrogenation zone is operated at a temperature of from about 550° F. to about 700° F.

8. The process of claim 1 wherein the gas phase effluents from the first and second hydrogenation zones are cooled sufficiently to condense at least a portion of the vaporized liquid components thereof, and the condensed vaporized liquid components are separated from the remaining gas components and returned as liquid feed to the first hydrogenation zone.

9. The process of claim 1 wherein the gas phase effluents from the first and second hydrogenation zones are cooled sufficiently to condense at least a portion of the vaporized liquid components thereof, and the condensed vaporized liquid components are separated from the remaining gas components and returned as liquid feed to the second hydrogenation zone.

10. The process of claim 8 wherein said condensed vaporized liquid components include materials boiling above about 350° F.

11. The process of claim 10 wherein said remaining gas components include hydrogen and materials boiling between about 85° F. and 350° F., and further comprising separating said materials boiling between about 85° F. and 350° F. from said hydrogen.

12. The process of claim 9 wherein said condensed vaporized liquid components include materials boiling above about 350° F.

13. The process of claim 12 wherein said remaining gas components include hydrogen and materials boiling between about 85° F. and 350° F., and further comprising separating said materials boiling between about 85° F. and 350° F. from said hydrogen.

14. The process of claim 1 wherein said first hydrogenation zone includes a first reaction stage and a second reaction stage.

* * * * *